US005117077A

United States Patent [19]

Sakurada

[11] Patent Number: 5,117,077

[45] Date of Patent: May 26, 1992

[54] KEYBOARD SWITCH

[75] Inventor: Hidemasa Sakurada, Tokyo, Japan

[73] Assignee: S M K Co., Ltd., Japan

[21] Appl. No.: 693,025

[22] Filed: Apr. 30, 1991

Related U.S. Application Data

[63] Continuation of Ser. No. 498,661, Mar. 26, 1990, abandoned.

[30] Foreign Application Priority Data

Jun. 9, 1989 [JP] Japan ..... 1-104596[U]

[51] Int. Cl.[5] ..... H01H 1/10

[52] U.S. Cl. ..... 200/516; 200/301; 200/408; 267/161

[58] Field of Search ..... 200/288, 301, 342, 408, 200/409, 469, 511, 512, 516, 517, 5 A; 267/158, 159, 161, 181

[56] References Cited

U.S. PATENT DOCUMENTS

| | | | |
|---|---|---|---|
| 4,084,071 | 4/1978 | Smith | 200/516 X |
| 4,127,752 | 11/1978 | Lowthorp | 200/516 |
| 4,164,634 | 8/1979 | Gilano | 200/511 X |
| 4,334,134 | 6/1982 | Janda | 200/516 |
| 4,341,934 | 7/1982 | Muller | 200/517 |
| 4,405,845 | 9/1983 | Kondo et al. | 200/408 |
| 4,486,637 | 12/1984 | Chu | 200/517 |
| 4,527,030 | 7/1985 | Oelsch | 200/517 |
| 4,529,849 | 7/1985 | Kamei et al. | 200/517 X |
| 4,608,465 | 8/1986 | Harada | 200/512 X |
| 4,638,151 | 1/1987 | Suwa | 200/517 |
| 4,753,423 | 6/1988 | Ukai et al. | 267/167 |
| 4,864,085 | 9/1989 | Hanajima et al. | 200/517 X |

*Primary Examiner*—Ernest G. Cusick
*Assistant Examiner*—Glenn T. Barrett
*Attorney, Agent, or Firm*—Lowe, Price, LeBlanc & Becker

[57] ABSTRACT

A reversing plate is provided between a depressing barrel which is engaged with a key top and a membrane contacts on a frame, wherein the reversing plate is bent toward the depressing barrel and, when a depression force applied by the depressing barrel exceeds a predetermined buckling limit, the bending direction of the reversing plate reverses toward the membrane contacts. The reversing plate is made of a plate spring and is composed of a slim peripheral piece which is bent by being provided a bending portion at several positions, a central piece astride in the approximate center of the peripheral piece, and a contact pressing piece provided at the central piece. When the key is depressed, the central piece of the reversing plate is moved under pressure transmitted through the depressing barrel, twisting the peripheral piece. When this twist exceeds the buckling limit, the reversing plate suddenly reverses to buckle toward membrane contacts, thereby pressing the membrane contacts at the contact pressing piece to turn on the switch. When the key is released, the reversing plate suddenly reverses toward the depressing barrel to make the twist of the peripheral piece return, thereby the contact pressing piece parting from the membrane contacts to turn off the switch.

6 Claims, 2 Drawing Sheets

KEYBOARD SWITCH

This application is a continuation of application Ser. No. 07/498,661 filed Mar. 26, 1990 now abandoned.

BACKGROUND OF THE INVENTION

1. Field of the Invention

The present invention relates to a thin type keyboard switch with tactile feedback.

2. Description of the Prior Art

Generally, membrane contacts are formed by as shown in FIG. 4, two pieces of flexible stamped plates (3). A spacer (2) interposed laminated on a rigid frame (1) such as metal with upper and lower contacts (5) facing each other at the portion of hole (4) located in the spacer (2).

In a conventional key switch for turning each membrane contacts on or off, as shown in FIG. 4, a rubber reversing plate (6) is laminated so as to be relatively thin at a surrounding portion and to form a pressing projection (8) only at the center portion on the lower face of a bulge (7) at every contact of such rubber reversing plate (6). 4 depressing barrel (11) is depressed through a coil spring (10) by pressing a key top (9), thereby bringing membrane contacts (5) together by the pressing projection (8) of the rubber reversing plate (6).

As to a conventional keyboard switch for pressing the membrane contacts, the height of the bulge (7) of the rubber reversing plate (6) was very high. This height increase the thickness of whole of the keyboard switch and resulted in a hindrance to realize the thin keyboard switch. Further, as for the rubber reversing plate (6), if the bulge (7) was depressed for a fixed distance, peripheral portion (13), being relatively thin, was reversed. But, since the material of the reversing plate was rubber, the user could not feel the clear click feeling at the tip of finger when the keyboard was depressed.

A first object of the present invention is to obtain a thin key board switch in which the height of whole of a keyboard switch is restrained.

A second object of the present invention is to obtain an improved keyboard switch having a clear operating tactile feedback feeling at the time of depressing a key top, and which can achieve the stable conductivity at the membrane contacts.

A third object of the present invention is to obtain a keyboard switch having simple reversing plate structure with low cost.

A fourth object of the present invention is noiseless key board switch implementing by interposing a synthetic resin cover or a cloth having the effect of absorbing noise between a reversing plate and a depressing barrel of the key top.

Still other objects and advantageous features of the present invention will be presented in the following description.

BRIEF SUMMARY OF THE INVENTION

In a keyboard switch for turning membrane contacts on or off state through a reversing plate, by the depressing of a key top, the reversing plate is made of a plate spring and is composed of a slim, deformable peripheral piece, with a bending portion at the several positions, a central piece astride in the approximately center of the peripheral piece, a contact pressing piece provided on the central piece. When the key top is depressed, the central piece of the reversing plate is pressed through the depressing barrel, and the bending portion of the peripheral piece is twisted. If such twist of the peripheral piece exceeds a buckling limit, the reversing plate suddenly reverses and bends toward the membrane contacts, so that the contact pressing piece presses the membrane contacts to turn the switch on.

If the key top is released, the reversing plate suddenly reverses toward the depressing barrel to make the twist of the peripheral piece return, and the contact pressing piece is separated from the membrane contacts, thereby turning the switch off. Further, the depressing barrel and the key top are lifted.

BRIEF DESCRIPTION OF THE DRAWINGS

FIG. 3 (*b*) is a side view of reversing plate.

FIG. 3 (*c*) as shown herein, is a front view of reversing plate.

DETAILED DESCRIPTION OF THE INVENTION

Figure 2:
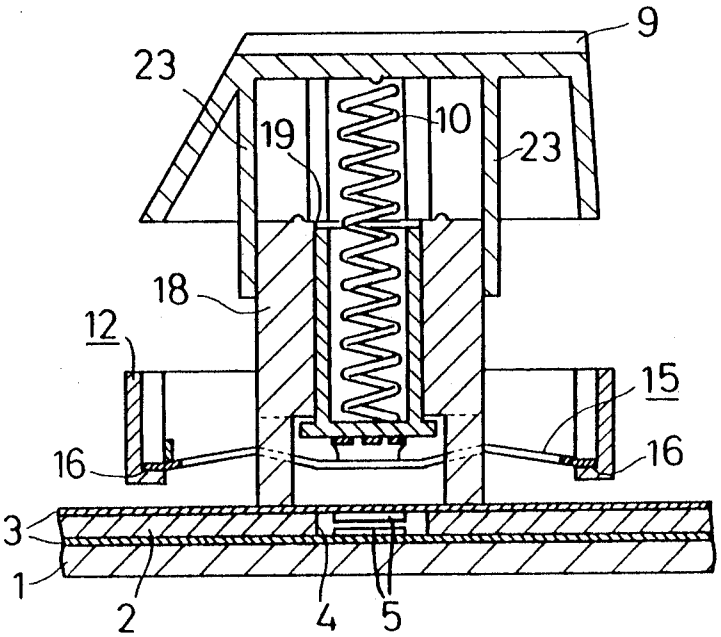
FIG. 2 is a side sectional view of the keyboard switch of FIG. 1.
Figure 1:
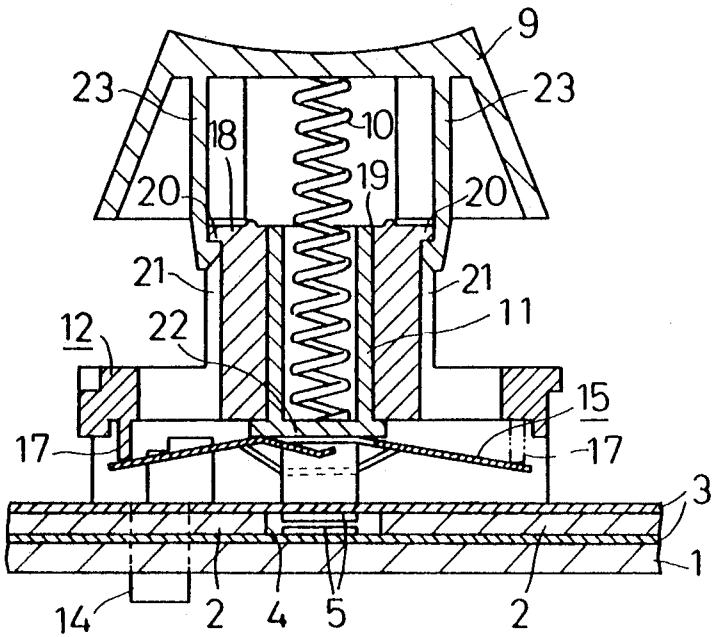
FIG. 1 is a front sectional view showing a keyboard switch according to the one embodiment of the present invention.
Figure 4:
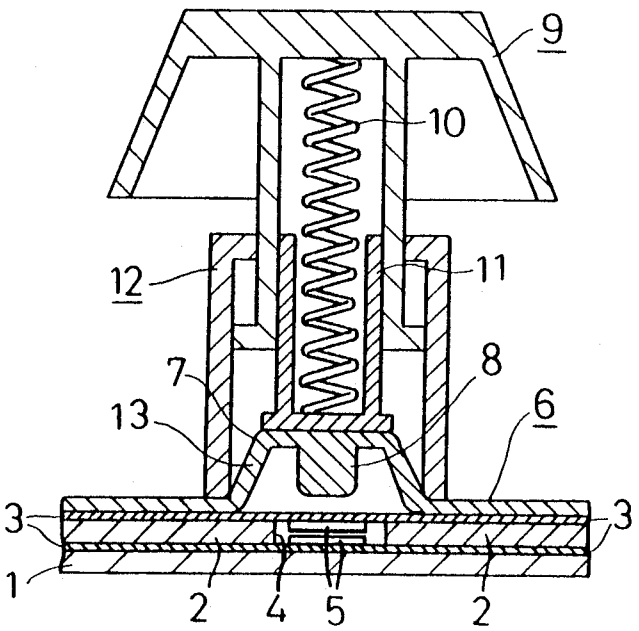
Fig. 4 PRIOR ART
FIG. 4 is a sectional view of a conventional keyboard.
Figure 3B:
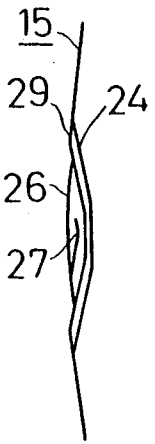
FIG. 3 (*a*) is a plane view of reversing plate.
Figure 3A:
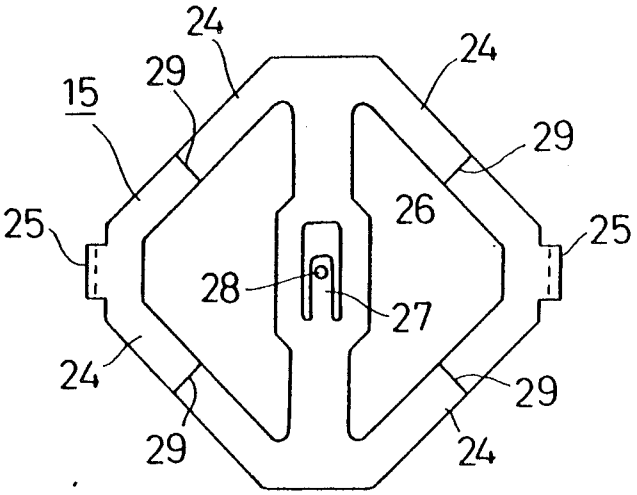
Figure 3C:
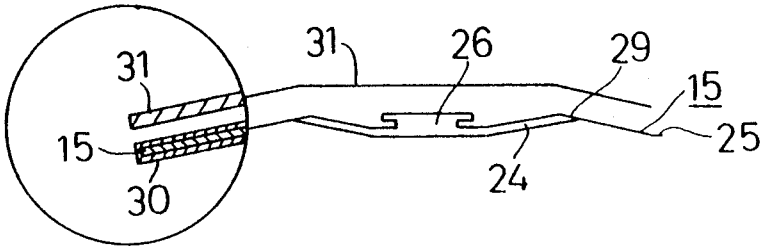

Hereinafter, reference is made to the explanation on the one embodiment of the present invention based on FIGS. 1 to 3. As shown herein the structure of a frame (1), a spacer (2), stamped plates (3), and hole (4), and membrane contacts (5) is same as in the conventional type switch shown in FIG. 4.

Molded plastic housing (12) is provided under a key top (9). A leg part (14) is located under housing (12) and penetrates through flexible plates (3), the spacer (2), and the frame (1) and is fixed on the frame (1) by melting the projected portion. Under the housing (12), a stop grooves (16) are formed in the both sides thereof for attaching a reversing plate (15), and a return projection (17) is formed under housing (12) at a right angle relative to stop grooves (16). In this embodiment, only one return projection (17) is provided to facilitate engagement with the reversing plate (15). But, it is desirable that another projection is preferably provided at the opposite side, as shown in FIG. 1 as shown with dashed line, absorb or attenuate noise as well as to obtain a positive return stroke. A support (18) is formed at the center of the top face of housing (12) in one body with the housing, and a perpendicular penetrating hole (19) is made at the center of this support (18). Further, in both outer sides of the support (18), perpendicular guide (21) having a stop projection (20) at the upper side.

A depressing barrel (11) having a bottom portion (22) is engaged penetrating hole (19) of the housing (12) from the lower side, each of claw elastic engaging pieces (23) located under the key top (9) are engaged with the guide grooves (21). A coil spring (10) is interposed between the key top (9) and depressing barrel (11).

Reversing plate (15) is formed by press punching a plate spring. A peripheral piece (24) of the plate (15) has a narrow width and forms approximately right square. Tab pieces (25), which are stopped by the stop grooves (16) of the housing (12) are provided in the corners of both sides of the peripheral piece (24). A central piece

(26) is formed in one body astride in the other corners of the peripheral piece (24). In the approximate center of the central piece (26), a contact pressing piece (27) is formed by cutting, and a projection (28) extending downward is formed in the center thereof. Further, in the peripheral piece (24) of the reversing plate (15), four bending portions (29) are provided by bending the approximately center portions between corners so as to make the line to turn down at the corners. As a result, the center portion bulges upward and bends to the upper side so that the center of the central piece (26) protrudes up.

Reversing plate (15) is formed as mentioned above, wherein when the both sides of tab parts (25) are stopped by the stop grooves (16) of the housing by the pressure, the center of the central piece (26) lifts the depressing barrel (11) upward, and one of the other corners of the peripheral piece (24) contacts with the return projection (17).

When the key top (9) is depressed, the reversing plate (15) is depressed by the descent of the key top (9) through the coil spring (10) and the depressing barrel (11). The reversing plate (15) is supported at the two points on both sides and the central piece (26) is lowered. If the reversing plate (15) is twisted exceeding the buckling limit of the pressing force at the bending portion (29) of the peripheral piece (24), the central piece (26) suddenly reverses downward, thereby turning the membrane contacts (5) on by means of the contact pressing piece (27) located in the center of the central piece (26).

If the key top (9) is released, the key top (9) is lifted up by the coil spring (10). Further, the reversing plate (15) lifts the central piece (26) untwist the peripheral piece (24) and, when it exceeds the limit, the central piece (26) suddenly reverses upward, thereby lifting the depressing barrel (11) and the coil spring (10) into the original position.

If the reversing plate (15) contacts with the return projection (17) during lifting, the reversing plate (15) reverses upward at this return projection (17), which functions as a fulcrum. That is, this reversing plate (15) always reverses at the fixed stroke by means of the return projection (17) and the mechanical shock is absorbed.

Since the reversing plate (15) is made of a metal plate having an elastic property, it makes a noise each time it buckles. In order to prevent such noise, as shown in the enlarged section of FIG. 3 (*c*), the whole of reversing plate (15) is covered with synthetic resin such like vinyl chloride or a cloth (31). The covering (31) has the effect of absorbing noise and is interposed between the reversing plate (15) and the depressing barrel (11). Of course, if both are used at the same time, increased noise absorption can be obtained.

Although the bending portion (29) is formed at the four positions of the peripheral piece (24) of the reversing plate (15) to form a sharp line to turn down at the corners is this embodiment, a line curving a soft slope can be also employed.

What is claimed is:

1. A keyboard switch comprising:

a membrane including first and second switching contacts;

a reversing plate for engaging said membrane, said reversing plate including a spring plate with a narrow closed rectangular peripheral strip forming a central opening and a central strip spanning from opposite corners of said peripheral strip across a geometric center of said opening in said peripheral strip forming two substantially equivalent substantially triangular voids between said peripheral strip and said central strip on opposite sides of said central strip, and a contact pressing piece provided in a central portion of said central strip, said peripheral portion of said reversing plate being bent so that said central portion is bulged; and a key top for engaging said reversing plate and moving said reversing plate into contact with said membrane to operate said first and second contacts.

2. The keyboard switch according to claim 1, wherein, said reversing plate is covered with a synthetic resin.

3. The keyboard switch according to claim 1, wherein said contact pressing piece is positioned within a void in said central strip, a first end of said contact pressing piece attached to said central piece and a second end of said contact pressing piece spaced apart from said central piece in said in a central portion of said void in said central piece.

4. A keyboard switch comprising:

a switch housing;

a membrane mounted in a bottom end of said switch housing and including first and second switching contacts;

a reversing plate mounted in said switch housing adjacent and above said membrane, said reversing plate operable to engage said membrane and including a spring plate with a narrow closed rectangular peripheral strip forming a central opening and a central strip spanning from opposite corners of said peripheral strip across a geometric center of said opening in raid peripheral strip forming two substantially equivalent substantially triangular voids between said peripheral strip and said central strip on opposite sides of said central strip, and a contact pressing piece provided in a central portion of said central strip, said peripheral portion of said reversing plate being bent so that said central portion is bulged, said spring plate being deformable in response to force applied perpendicular to a major surface of said central portion of said strip to cause said central portion of said central strip to deformably buckle toward and engage said membrane, said peripheral strip having peripheral mounting tabs for securing said spring plate in said switch housing; and a key top having a barrel portion for engaging said reversing plate and moving said reversing plate toward said membrane, causing said central portion of said central strip to buckle and thereby engage said membrane to operate said first and second contacts.

5. The keyboard switch according to claim 4, wherein said contact pressing piece is positioned within a void in said central strip, a first end of said contact pressing piece attached to said central piece and a second end of said contact pressing piece spaced apart from said central piece in said in a central portion of said void in said central piece.

6. A keyboard switch comprising:

a membrane including first and second switching contacts;

a reversing plate for engaging said membrane, said reversing plate including a spring plate with a narrow closed peripheral strip and a central strip spanning from opposite sides of said peripheral strip across a geometric center of said peripheral strip forming two substantially equivalent voids between said peripheral strip and said central strip on opposite sides of said central strip, and a contact pressing piece provided in a central portion of said central strip, said peripheral portion of said reversing plate bent so that said central portion is bulged; and a key top for engaging said reversing plate and moving said reversing plate into contact with said membrane to operate said first and second contacts; and a cloth for absorbing noise interposed between said reversing plate and the key top.

* * * * *